US006325649B2

(12) United States Patent
Stockhaus et al.

(10) Patent No.: US 6,325,649 B2
(45) Date of Patent: Dec. 4, 2001

(54) DEVICE FOR RELEASABLY MOUNTING AN ELECTRONIC COMPONENT

(75) Inventors: Andreas Stockhaus; Klaus Schulz, both of Berlin (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/815,655

(22) Filed: Mar. 23, 2001

Related U.S. Application Data

(63) Continuation of application No. PCT/DE99/02923, filed on Sep. 9, 1999.

(30) Foreign Application Priority Data

Sep. 23, 1998 (DE) ..... 198 43 708

(51) Int. Cl.[7] ..... H01R 13/62
(52) U.S. Cl. ..... 439/180; 439/267
(58) Field of Search ..... 439/65, 66, 180, 439/266, 267, 630

(56) References Cited

U.S. PATENT DOCUMENTS

| | | |
|---|---|---|
| 4,288,140 | 9/1981 | Griffith . |
| 5,546,281 | 8/1996 | Poplawski . |
| 6,142,802 * | 11/2000 | Berg et al. ..... 439/180 |

FOREIGN PATENT DOCUMENTS

| | | |
|---|---|---|
| 27 07 122 C2 | 4/1982 | (DE) . |
| G 89 01 711.0 | 4/1990 | (DE) . |
| 39 30 772 A1 | 3/1991 | (DE) . |
| 197 09 231 C1 | 6/1998 | (DE) . |
| 0 018 422 A1 | 11/1980 | (EP) . |
| 0 790 570 A2 | 8/1997 | (EP) . |
| WO 98/27507 | 6/1998 | (WO) . |

* cited by examiner

*Primary Examiner*—Khiem Nguyen
(74) *Attorney, Agent, or Firm*—Herbert L. Lerner; Laurence A. Greenberg; Werner H. Stemer

(57) ABSTRACT

A releasable mounting device includes an electronic component having terminal contact surfaces disposed in at least two rows on an outer side. Corresponding contacts of a terminal part are correspondingly disposed in two contact rows. The contacts of each contact row can be moved jointly away from the outer side by an actuating element. During a mounting operation, the contact rows of the terminal part, which are located one behind the other as seen in a mounting direction, are moved away from the outer side one after the other by the component, beginning with a front contact row. When an end mounting position is reached, the contact rows of the terminal part pass into electrical contact with the terminal contact surfaces.

7 Claims, 3 Drawing Sheets

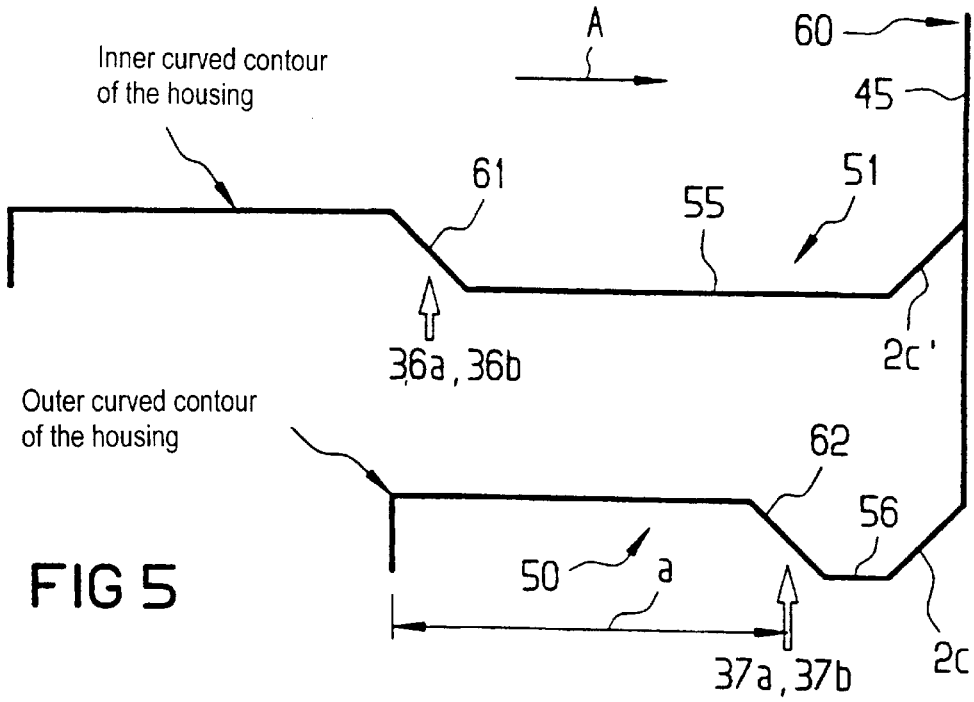
FIG 5
FIG 6
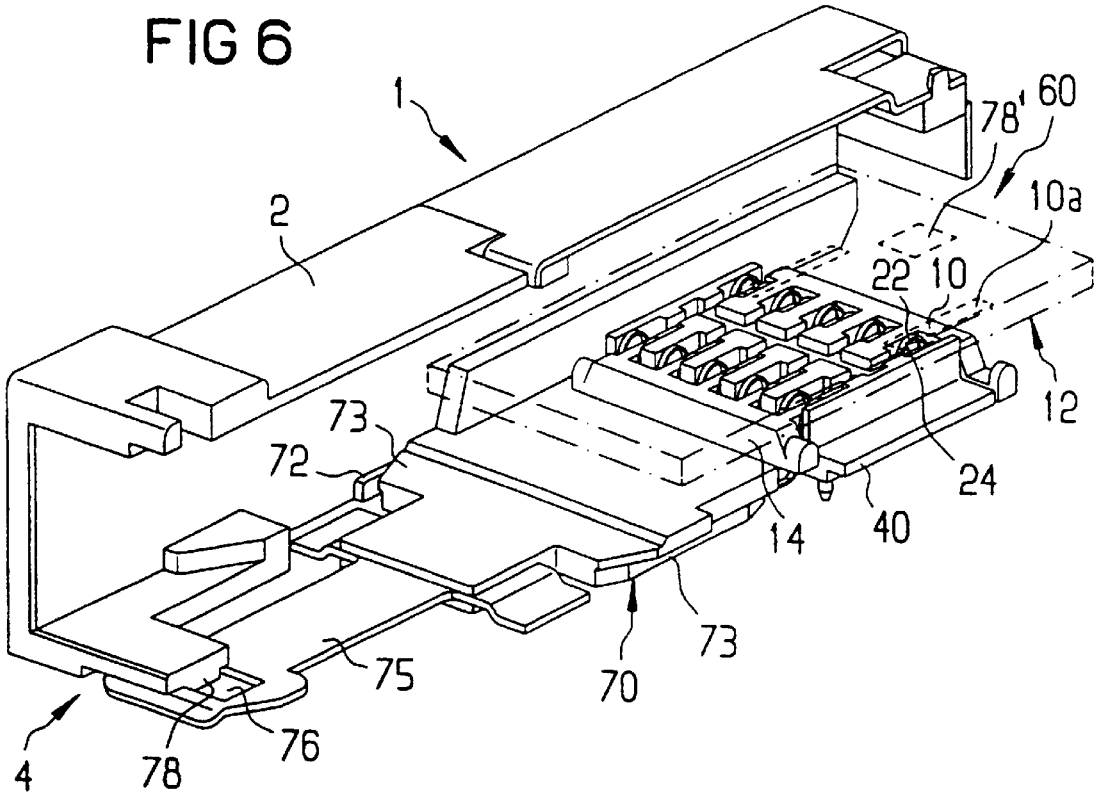

DEVICE FOR RELEASABLY MOUNTING AN ELECTRONIC COMPONENT

CROSS-REFERENCE TO RELATED APPLICATION

This application is a continuation of copending International Application No. PCT/DE99/02923, filed Sep. 9, 1999, which designated the United States.

BACKGROUND OF THE INVENTION

Field of the Invention

The invention relates to the field of mounting electronic components or modules, in particular electrooptical modules (so-called transceivers). In order to mount such modules on carriers, in particular printed circuit boards provided with conductor tracks and terminal contacts, the user requires modules which can be placed on the printed circuit board, and contact-connected, in a comparatively free and unrestricted manner. It may thus be necessary, for example, for it to be possible for a module to be disposed centrally on a printed circuit board and, in particular, once the printed circuit board has been otherwise completely fitted out, to be mounted and/or removed again.

U.S. Pat. No. 5,546,281 discloses a module which can be positioned (mounted) on a printed circuit board vertically from above and which slides in the process, by way of electrical contacts projecting perpendicularly to its underside, into a corresponding connection base of the printed circuit board. During the mounting or demounting of the module, a comparatively large clearance is necessary above the top side of the printed circuit board in order for it to be possible for the module to be gripped and mounted or removed vertically. In many applications, however, a very closely adjacent configuration of a plurality of parallel printed circuit boards fitted out with modules is provided. As a result, the necessary vertical clearance is at least not readily available (e.g. is not available without a considerable number of adjacent printed circuit boards being demounted).

In such applications, it is desirable for it to be possible for the module to be mounted essentially by a horizontal push-in movement running parallel to the top side of the printed circuit board. However, in particular with an electrical connection between the module and the printed circuit board through a multiplicity of electrical contacts, that may result in a problem where resilient contacts of the printed circuit board rub against correspondingly associated terminal contact surfaces of the module or on the underside of the module, during the mounting or demounting operation. That is particularly problematic with a multi-row terminal configuration, which is desirable with respect to a comparatively narrow construction of the module. Although it would indeed be possible, in principle, to ensure that the module is raised during the movement over the corresponding contacts, and to set the module down only when it is over the contacts, that would require complicated guidance and/or a reduction in size of the module at least in the region where contact is made. As a result, the overall volume available for electronic components would be considerably reduced in the module interior.

German Utility Model G 89 01 711.0 discloses contact-making devices which ensure that contact is reliably made without damaging metal-conductor tracks of an electronic component, in particular of a liquid crystal display. For that purpose, contact elements which are formed between two housing halves, in single row as bow springs, are provided at one end with a bow-like bearing bracket. In order to mount the components, it is possible for free ends of the bow springs to be temporarily drawn back out of, or forced away from, the region at risk. That requires a separate, manual movement, for example, through the use of a cam shaft, of a wedge or of a push rod. Those auxiliary devices each form part of a separate comb-like tool, which is used independently of the mounting operation.

U.S. Pat. No. 4,288,140 discloses a device of the generic type which is intended for releasably mounting a component on a terminal part and in the case of which rows of contacts that are located one behind the other as seen in the mounting direction are provided on the outer side of the component and on the terminal part. Guides of the component and the terminal part bring about a guided relative movement between the terminal contact surfaces of the component and the contacts of the terminal part during the mounting operation into an end position, in which the contacts are in contact with the terminal contact surfaces. The guided relative movement is such that the contacts of all of the contact rows are raised at the same time in relation to the contacts of the component. That disadvantageously requires a relatively large amount of space to be made available.

SUMMARY OF THE INVENTION

It is accordingly an object of the invention to provide a device for releasably mounting an electronic component, which overcomes the hereinafore-mentioned disadvantages of the heretofore-known devices of this general type and which, in the case of a component of comparatively small construction, allows optimum utilization of the interior of the component along with careful contact-connection of terminal contact surfaces on the component, even with multiple mounting/demounting.

With the foregoing and other objects in view there is provided, in accordance with the invention, a releasable mounting device, comprising an electronic component having an outer side and terminal contact surfaces disposed on the outer side in at least two rows located one behind the other as seen in a mounting direction. A terminal part is to be releasably mounted to the component in the mounting operation and includes a basic part and an actuating element. The basic part has contacts assigned to the terminal contact surfaces and disposed in contact rows corresponding to the at least two rows of the terminal contact surfaces, for making electrical contact between the terminal contact surfaces and the contacts during the mounting operation. The component and the terminal part have guides interacting during the mounting operation for guiding a relative movement of the terminal contact surfaces and the contacts into an end position in which the contacts contact the terminal contact surfaces. The actuating element moves the contacts of each of the contact rows away from the outer side of the electronic component. The actuating element has parts assigned to each of the contact rows for temporarily moving the contact rows away from the outer side of the component one after the other during the mounting operation.

In this case, guides of the component and the terminal part interact in such a way that, during the mounting operation, a guided relative movement takes place between the terminal contact surfaces and the contacts of the terminal part into an end position, in which the contacts are in contact with the terminal contact surfaces.

An essential aspect of the device according to the invention is that two or more preferably parallel contact rows may be provided, as a result of which the overall width of the module can be kept small, with a high number of contacts.

However, the sequential actuation (forcing down the contact rows as the terminal contact surfaces cross over the contact rows) ensures very careful contact-connection of the component. It is thus an essential aspect of the invention that contact with the contact rows can be made and broken individually. In this case, the contacts of each contact row are moved jointly out of the introduction path of the module. The module interior for electronic component parts thus need not be reduced in size for mounting-related reasons and can be utilized optimally.

In accordance with another feature of the invention, the component has at least one guide track, which moves the actuating elements during the mounting operation.

In accordance with a further feature of the invention, the contacts of a contact row are each enclosed by a common frame as an actuating element.

In accordance with an added feature of the invention, a contribution is made toward further reducing the number of individual parts of the terminal part if the frames are constructed as constituent parts of an overall frame. The leading moving-away action of the first contact row, as seen in the mounting direction and/or demounting direction, may advantageously be realized in this case in such a way that the overall frame is mounted in each case on the contact rows.

In accordance with an additional feature of the invention, there are provided cams moved by guide tracks and preferably integrally formed on the frames, in order to actuate the frames.

In accordance with yet another feature of the invention, in order to provide particularly uniform force transmission and tilt-free actuation of the frames, the component has symmetrical guide tracks which interact with correspondingly symmetrically disposed cams.

In accordance with a concomitant feature of the invention, a particularly space-saving construction of a track guide can be realized by providing a guide track which cooperates with a first cam and is formed on the inside of a longitudinal side of a component frame and a guide track which cooperates with a second cam and is formed on the outside of a longitudinal side.

In this case, the elements (e.g. cams) which are preferably constructed as cams and cooperate with the guide tracks, are correspondingly offset on the frames.

Other features which are considered as characteristic for the invention are set forth in the appended claims.

Although the invention is illustrated and described herein as embodied in a device for releasably mounting an electronic component, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is a line diagram showing a configuration of guide tracks of the component; and FIG. 6 is a perspective view showing a component connected electrically and mechanically to a mount.

DESCRIPTION OF THE PREFERRED EMBODIMENTS

Figure 1:
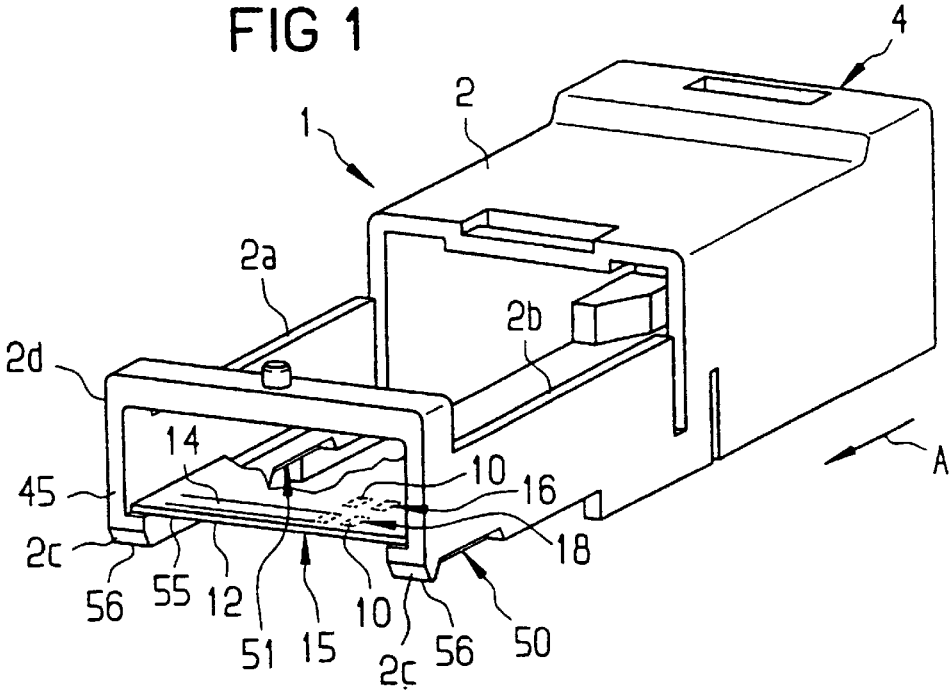
FIG. 1 is a diagrammatic, partly broken-away, perspective view of an electronic component, which is presented to clarify aspects that are essential to the invention, but in which inner electronic component parts of the same are not shown.

Referring now to the figures of the drawings in detail and first, particularly, to FIG. 1 thereof, there is seen an electronic component 1, of which only a component housing 2 is illustrated in detail for reasons of simplification. The component 1 may be configured, for example, as an electrooptical module (transceiver), of which a front region 4 is constructed for accommodating non-illustrated optical connectors. The connectors serve for connecting optical waveguide ends to electrooptical transducer components disposed in the module 1. The transducer components (for example laser diodes and/or photodiodes) convert electric activating signals into optical signals and/or optical signals into electric receiving signals. The electric signals, which, if appropriate, are to be conditioned or have been conditioned, are routed to and from terminal contact surfaces 10. The terminal contact surfaces 10 are indicated merely by way of example and serve for external contact-connection of the component 1 and/or of the electronic component parts contained therein.

The terminal contact surfaces 10 are disposed on an underside 12 of a printed circuit board 14 (and are thus only depicted by dashed lines). The printed circuit board forms an outer side 15 of the component 1. The terminal contact surfaces 10 are disposed in two parallel rows 16, 18 which run at right angles to the longitudinal axis of the component. The longitudinal axis of the component coincides with a mounting direction or push-in direction A, along which the component 1 is pushed-in relative to a terminal part in a manner which will be described in more detail hereinbelow.

Figure 2:
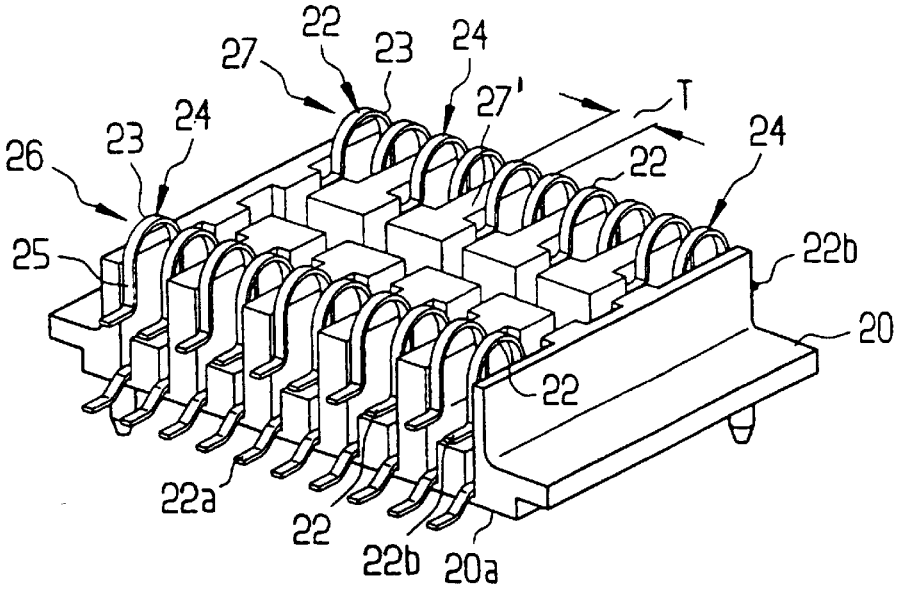
FIGS. 2 and 3 are enlarged, perspective views of individual parts of a terminal part.

The illustration of FIG. 2, which is vastly enlarged in relation to the component according to FIG. 1, shows a basic part 20, which may be produced, for example, by injection moulding. Resiliently movable contacts 22 are retained in the basic part. The contacts have the approximate shape of an oval loop 23. In each case a top round region of the oval loop serves as a contact surface 24. As will be explained in more detail hereinbelow, the contact surface 24 forms a reliable electrical contact, in the mounted state of the component, with the terminal contact surface 10 of FIG. 1 which is assigned thereto. The oval loop 23 formed by the contacts 22 is open in a bottom region in such a way that respective open ends 22*a*, 22*b* of the mirror-symmetrical contacts 22 are bent outward approximately at right angles from a longitudinal region 25 of the loop. The bottom ends 22*a* in this case are bent slightly toward an underside 20*a* of the basic part 20 and thus form soldering surfaces which are suitable, in particular, for surface mounting. The essential advantages of this contact configuration are that the soldering surfaces are easily accessible from the outside, and that the basic part 20 can nevertheless accommodate a multiplicity of contacts having a compact and straightforward construction. The respective top ends 22*b* form bearing surfaces for actuating the contacts 22, on which an actuating element (for example of the type shown in FIG. 3) rests. The contacts 22 are disposed in two contact rows 26, 27. The surfaces 24 of the contacts and a spacing T between them correspond to the configuration of the terminal contact surfaces 10 of the component 1 shown in FIG. 1. In each case two contacts 22 are located between intermediate blocks 27'.

Figure 3:
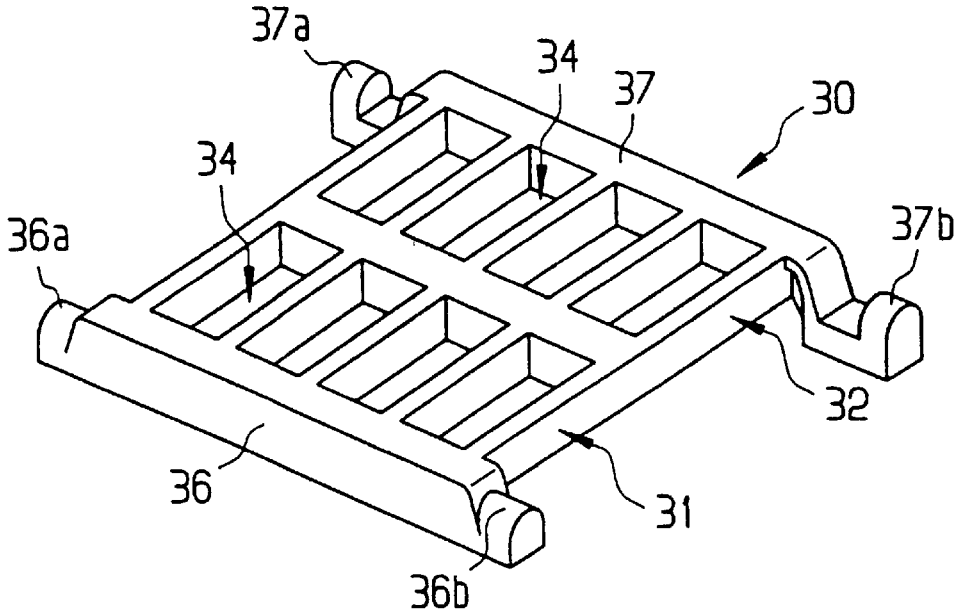

An actuating element 30 shown in FIG. 3 is constructed in the form of a double frame with integral sub-frames 31, 32. Each sub-frame 31, 32 has rectangular openings 34 which are coordinated in their dimensions with the intermediate blocks 27' and the spring contacts 22 of the basic part 20 shown in FIG. 2. The spring contacts are disposed on both sides of the intermediate blocks 27'. Parts in the form of cams 36*a*, 36*b* and 37*a*, 37*b* are integrally formed on respective end crosspieces 36, 37 of the overall frame 30. These cams serve, in a manner which will be explained in more detail hereinbelow, for moving the sub-frames 31, 32 as required and thus for moving the contacts 22 and/or the contact surfaces 24 thereof toward the base surface 20*a* of the intermediate part 20 shown in FIG. 2. As a result, the contacts 22 move away from the outer side 15 of the component during the mounting of the component 1.

Figure 4:
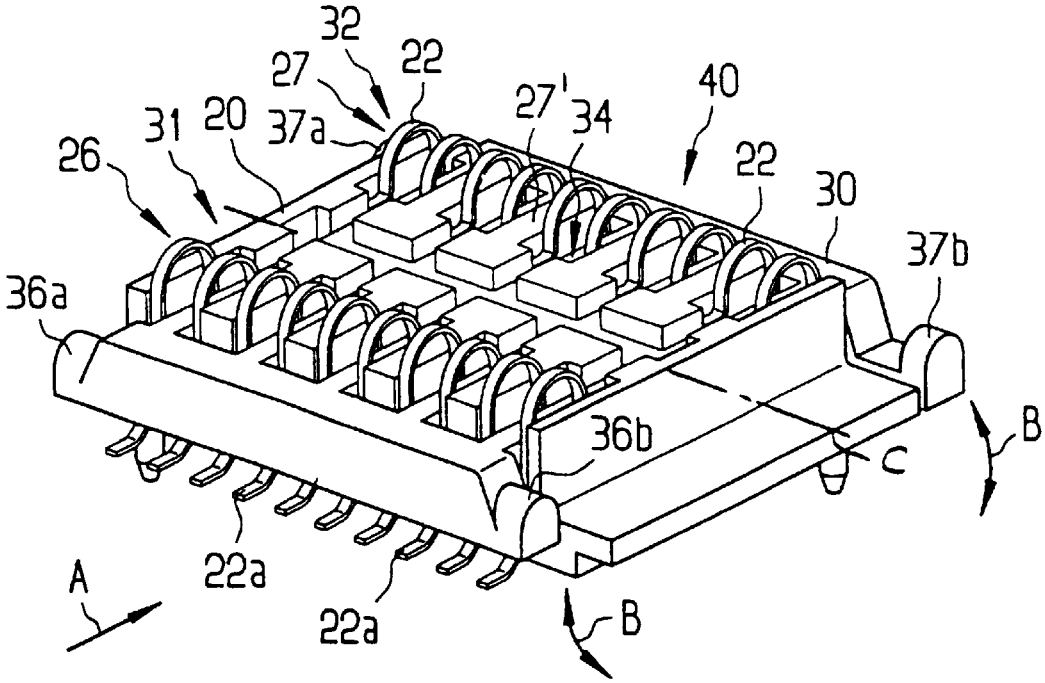
FIG. 4 is a perspective view of a terminal part.

FIG. 4 shows a terminal part 40 which is made up of the component parts shown in FIGS. 2 and 3. In FIG. 4, it is possible to see the contacts 22, which are disposed in the two rows 26, 27, and the bottom contact ends 22*a* for the surface mounting. The respective crosspieces 36 and 37 of FIG. 3 rest on the contact ends 22*b* of FIG. 2. The intermediate blocks 27' pass through the corresponding openings 34 in the sub-frames 31 and 32. The overall frame 30 is mounted on the bottom ends 22*a* of the contacts 22 in the manner of a rocker. The overall frame 30 can execute rotary/pivoting movements in the direction of arrows B—B with corresponding actuation of the cams 36*a*, 36*b* and 37*a*, 37*b*.

A description is given hereinbelow, with reference to FIGS. 1, 4 and 5, of the mounting and demounting of the component 1 with simultaneous contact being made through the terminal part 40. The illustration of FIG. 1 and a vastly enlarged illustration of FIG. 5 show a rear component edge 45 and inner and outer curved contours of guide tracks 50, 51 which are respectively formed parallel to one another in two narrow walls 2*a*, 2*b* of the housing 2. For clarification purposes, the push-in direction (mounting direction) A is indicated in each of FIGS. 1, 4 and 5. When the component 1 is introduced, first of all slopes 2*c* of a rear housing part 2*d* come into contact with the front cams 36*a*, 36*b*, as seen in the mounting direction A. In this case, the frame 30 is tilted about an axis C and, in the process, acts through the contact ends 22*b* to force the contacts 22 of the first contact row 26 downward and thus away from the outer side 15 seen in FIG. 1 and the terminal contact surfaces 10 of the component 1. This allows the terminal contact surfaces 10 of the contact row 18 to pass over the contacts 22 of the contact row 26 without contact. A supplementary rear-engagement device of the housing 2 and rail-like guide elements determine the horizontal guidance of the housing. After a mounting distance a shown in FIG. 5, the cams 37*a*, 37*b* are also forced downward by the slopes 2*c*, with the result that the terminal contact surfaces also cross over the contact row 27 without contact.

Shortly before an end position 60, in which the terminal contact surfaces 10 are located opposite the respectively associated contacts 22, with electrical contact being made, the cams 36*a*, 36*b*; 37*a*, 37*b* are released from the guide tracks 50, 51 which are formed on the narrow walls 2*a*, 2*b* on both sides. As a result, the contacts 22 spring up in the upward direction toward the outer side 15 and come into contact with the associated terminal contact surfaces 10.

In order to demount or remove the component 1, the latter is moved in a horizontal plane counter to the mounting direction A. Run-on slopes 61, 62 assigned to the respective cams 36*a*, 36*b* and 37*a*, 37*b* cause the cams, and thus the respective end pieces 36 and 37, to be forced down. Accordingly, the contacts 22 of both contact rows 26, 27 are removed one after the other from the associated terminal contact surfaces 10 and moved downward (away from the outer side 15). As the component 1 is drawn out further, first of all the cams 37*a*, 37*b*, having slid off sliding surfaces 56, are released and spring upward again due to spring prestressing. The contacts 22 of the first contact row 26, which are still located beneath the component 1 and/or the terminal contact surfaces 10, still remain in the forced-down position, due to the geometry of the guide track 51, until the cams 36*a*, 36*b* have also reached the slope on the rear housing wall. At this point in time, the terminal contact surfaces have already been moved away from the contacts 22 to such an extent, that there is no longer any risk of damage.

FIG. 6 shows the component 1 according to FIG. 1 undergoing mechanically fixed connection with a mount 70 due to crosspieces 72 engaging behind a corresponding rear-engagement device 73 of the mount 70. It is also possible to see a resilient tongue 75, having an opening 76 in which a latching nose 78 of the housing 2 is latched in the front region 4. Merely in order to simplify the illustration, the printed circuit board 14 contained in the housing 2 is illustrated in a partially transparent manner, thus making it possible to see the terminal part, which is disposed beneath the printed circuit board 14. The terminal part 40 may preferably be a constituent part of the mount 70. The contacts 22 of the terminal part 40 are covered by the respectively associated terminal contact surfaces 10 on the underside of the printed circuit board 14. In this case, the printed circuit board 14 is positioned in relation to the terminal part 40 in such a way that the terminal contact surfaces 10 are in contact with the contact surfaces 24 of the contacts 22 and resiliently compress the contacts 22. This ensures that electrical contact is reliably made between the respective contact 22 and the associated terminal contact surface 10. The terminal contact surfaces 10 merge into conductor tracks 10*a*, through which it is possible to act on electronic component parts 78, which are illustrated by way of example.

We claim:

1. A releasable mounting device, comprising:

an electronic component having an outer side and terminal contact surfaces disposed on said outer side in at least two rows located one behind the other as seen in a mounting direction; and a terminal part to be releasably mounted to said component in a mounting operation, said terminal part including a basic part and an actuating element;

said basic part having contacts assigned to said terminal contact surfaces and disposed in contact rows corresponding to said at least two rows of said terminal contact surfaces, for making electrical contact between said terminal contact surfaces and said contacts during said mounting operation;

said component and said terminal part having guides interacting during said mounting operation for guiding a relative movement of said terminal contact surfaces and said contacts into an end position in which said contacts contact said terminal contact surfaces; and said actuating element moving said contacts of each of said contact rows away from said outer side of said electronic component, and said actuating element having parts assigned to each of said contact rows for temporarily moving said contact rows away from said outer side of said component one after the other during said mounting operation.

2. The device according to claim 1, wherein said component has at least one guide track for guiding said actuating element during said mounting operation.

3. The device according to claim 1, wherein said contacts of each of said contact rows are enclosed by a respective common actuating sub-frame.

4. The device according to claim 3, wherein said actuating sub-frames are parts of an overall frame.

5. The device according to claim 3, wherein said component has guide tracks, and said parts of said actuating element are cams integrally formed on said actuating sub-frames and guided by said guide tracks.

6. The device according to claim 1, wherein said component has symmetrical guide tracks, and said parts of said actuating element are correspondingly symmetrically disposed cams interacting with said guide tracks.

7. The device according to claim 2, wherein said component has longitudinal sides with inner and outer surfaces, said at least one guide track includes one guide track on said inner surface of one of said longitudinal sides and another guide track on said outer surface of another of said longitudinal sides, and said parts of said actuating element include a first cam cooperating with said one guide track and a second cam cooperating with said other guide track.

* * * * *